US007010994B2

(12) United States Patent
Amici

(10) Patent No.: US 7,010,994 B2
(45) Date of Patent: Mar. 14, 2006

(54) DRIVE UNIT DESIGNED PARTICULARLY FOR BOATS

(75) Inventor: Alberto Amici, Pavia (IT)

(73) Assignee: R.T.N. S.R.L., Castelsangiovanni (IT)

( * ) Notice: Subject to any disclaimer, the term of this patent is extended or adjusted under 35 U.S.C. 154(b) by 106 days.

(21) Appl. No.: 10/807,170

(22) Filed: Mar. 24, 2004

(65) Prior Publication Data

US 2004/0187617 A1 Sep. 30, 2004

(30) Foreign Application Priority Data

Mar. 31, 2003 (IT) ..... PC2003A0013

(51) Int. Cl.
*F16H 19/00* (2006.01)

(52) U.S. Cl. ..... 74/323

(58) Field of Classification Search ..... 74/323, 74/322; 440/75

See application file for complete search history.

(56) References Cited

U.S. PATENT DOCUMENTS 1,011,746 A * 12/1911 Clark ..... 74/323
2,977,812 A * 4/1961 Hoof ..... 74/322
5,006,084 A * 4/1991 Handa ..... 440/75
5,509,863 A * 4/1996 Mansson et al. ..... 475/273
6,129,599 A * 10/2000 Hallenstvedt et al. ..... 440/86
6,884,131 B1 * 4/2005 Katayama et al. ..... 440/75

* cited by examiner

*Primary Examiner*—Dirk Wright
(74) *Attorney, Agent, or Firm*—Young & Thompson

(57) ABSTRACT

A drive unit for boats includes a transmission with two coaxial bevel gears, mounted opposite one another on the same engine shaft, which engage a bevel gear fitted to a shaft orthogonal to the preceding shaft, and elements to mesh the engine shaft with one of the bevel gears. The elements are constituted by clutches, each housed in a closed seating inside the body of the bevel gears. The engine shaft is mounted on a pair (or more) of bearings which are mounted on the housing of the device, and the opposite bevel gears are each fitted on one side to a bearing mounted on the housing and on the opposite side to at least one bearing, which in turn is mounted on a central support integral with the casing, so as to discharge the reaction forces onto the structure of the housing, and not onto the other rotating parts.

7 Claims, 3 Drawing Sheets

Fig. 3
(PRIOR ART)
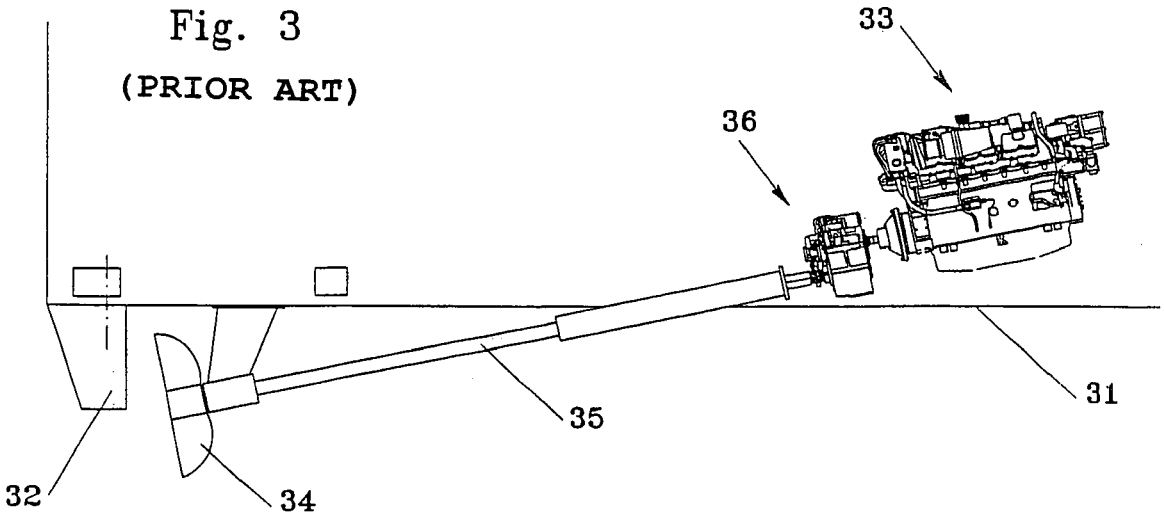
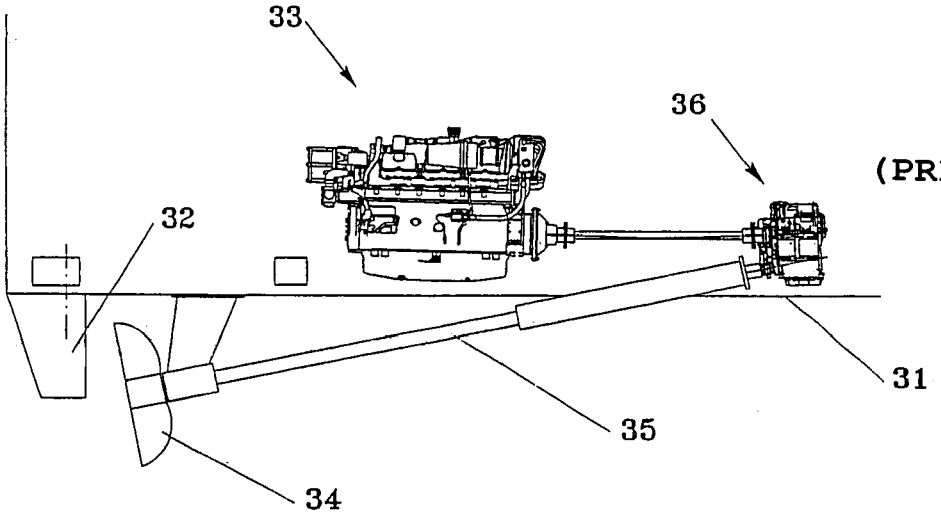
Fig. 4
(PRIOR ART)
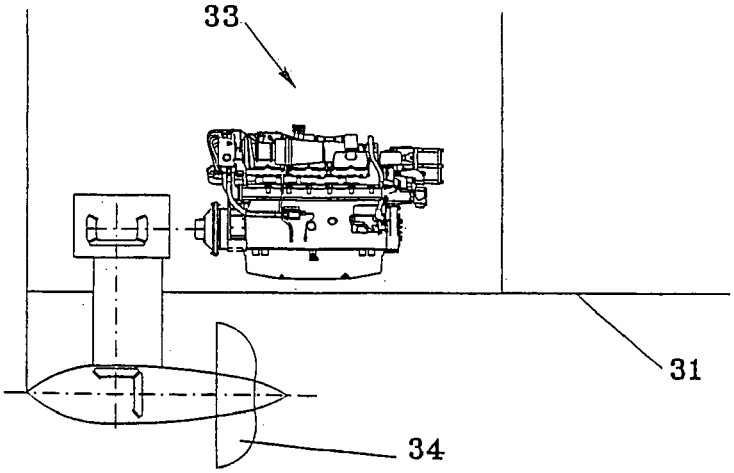
Fig. 5
(PRIOR ART)

DRIVE UNIT DESIGNED PARTICULARLY FOR BOATS

BACKGROUND OF THE INVENTION

This invention relates to a drive unit designed particularly for boats fitted with a stern drive, which incorporates a system designed to reverse the propeller rotation.

In particular it relates to a 90-degree transmission which comprises a pair of opposite coaxial bevel gears fitted idle on the engine shaft which engage with a bevel gear integral with the drive shaft, each of which said bevel gears mounted on the engine shaft is fitted with means designed to mesh said shaft with one of said bevel gears in order to control the rotation of the shaft leading to the propellers in one direction or the opposite direction.

Said means are constituted by multi-disk oil-bath clutches, and said bevel gears and said engine shaft are fitted to separate sets of bearings, all of which are mounted on the housing of the device.

Using this solution it is possible to make a stern drive which is very advantageous in terms of compactness, with no need to use a reverse gearbox, which would greatly increase the cost of the unit.

In accordance with the invention, the clutches are housed inside the bevel gears, and the pipes that convey pressurised oil to drive them pass through the shaft to which they are fitted, thus eliminating seal problems.

One of the greatest problems faced by boat designers is how to exploit the little available space to the utmost.

In small and medium-sized boats such as yachts, the problem of exploiting space as effectively as possible relates (among other things) to the size of the engine room, due to the type of drive currently used.

According to the state of the art, systems for the transmission of motion to the propellers can be divided into three categories.

The first and most common type is shown in FIG. 3, where numeral 31 indicates the keel of the boat, only schematized, and 32 indicates the rudder. In this embodiment the engine 33 is connected to the propeller 34 via an inclined shaft 35, with the interposition of a reverse reduction gearbox 36. As the shaft cannot have an inclination greater than 10 degrees, and the size of the propeller cannot be reduced, this configuration obviously has to be very long, with a consequent waste of valuable space, together with lubrication problems.

According to a partial solution to this problem, shown in FIG. 4, the reverse reduction gearbox is the type with conical gears (V-drive type) which allows the engine to be installed horizontally, on the same side of the propeller in relation to the reduction gearbox.

This solution saves a certain amount of space and enables the engine to be ideally positioned, but the reverse/reduction gearbox is very expensive due to the high cost of installing conical gears of sufficient size to transmit the required power.

A further solution, which is the most advantageous in terms of size, is shown in FIG. 5, and involves the use of a stern drive, also known as an "outboard" or strut drive.

In practice, this embodiment relates to a drive unit in which the motion output from the engine is transmitted to a substantially vertical shaft which, via a further transmission, causes the substantially horizontal propeller shaft to rotate.

This known configuration provides the greatest space saving, but it is hardly practical, because a reverse gearbox has to be associated with the transmission device; the overall cost is very high, with the result that this system is uncompetitive, and there is little demand for it.

SUMMARY OF THE INVENTION

In order to eliminate this drawback the applicant has developed a drive unit comprising a transmission with two coaxial bevel gears fitted opposite one another on the same engine shaft, which engage a bevel gear fitted to a shaft orthogonal to the preceding one.

Said transmission comprises means designed to mesh said engine shaft with one of said bevel gears in order to control rotation of the shaft leading to the propellers in one direction or the opposite direction, which said means are constituted by multi-disk clutches fitted inside said bevel gears. Said drive unit is described in patent application PC 2002 A 027 filed by the present applicant on Apr. 10, 2002.

Subsequent studies and trials have enabled the applicant to develop an improved drive unit of the type described above, which forms the subject of this application, and which in particular solves a number of seal problems and lubricates the device more effectively.

Bearing in mind that in these mechanisms, the oil which activates the clutches operates at a considerable pressure (approx. 25 bars), it is easy to understand the seal problems which need to be solved by experts in the field.

However, it is impossible to use mechanical seal devices, because they would soon overheat in view of the speed at which the mobile parts slide against the fixed structure of the casing through which the pipes pass, thus making the device practically useless.

This problem is solved by the present invention, according to which each of the bevel gears contains a closed seating designed to house the clutches, so that one set of disks meshes with the corresponding bevel gear and the other meshes with the shaft, and pressurised oil is conveyed along pipes coaxial with said shaft.

Thus a seal is only required in correspondence with the axial pipe and in places where the peripheral speed is minimal, thus avoiding the problems referred to above.

BRIEF DESCRIPTION OF THE DRAWINGS

This and other characteristics will appear more clearly from the detailed description set out below, provided by reference to the annexed figures wherein:

FIGS. 3 to 5 schematically show, as explained above, three embodiments of known drive units, respectively.

DESCRIPTION OF THE PREFERRED EMBODIMENTS

Figure 1:
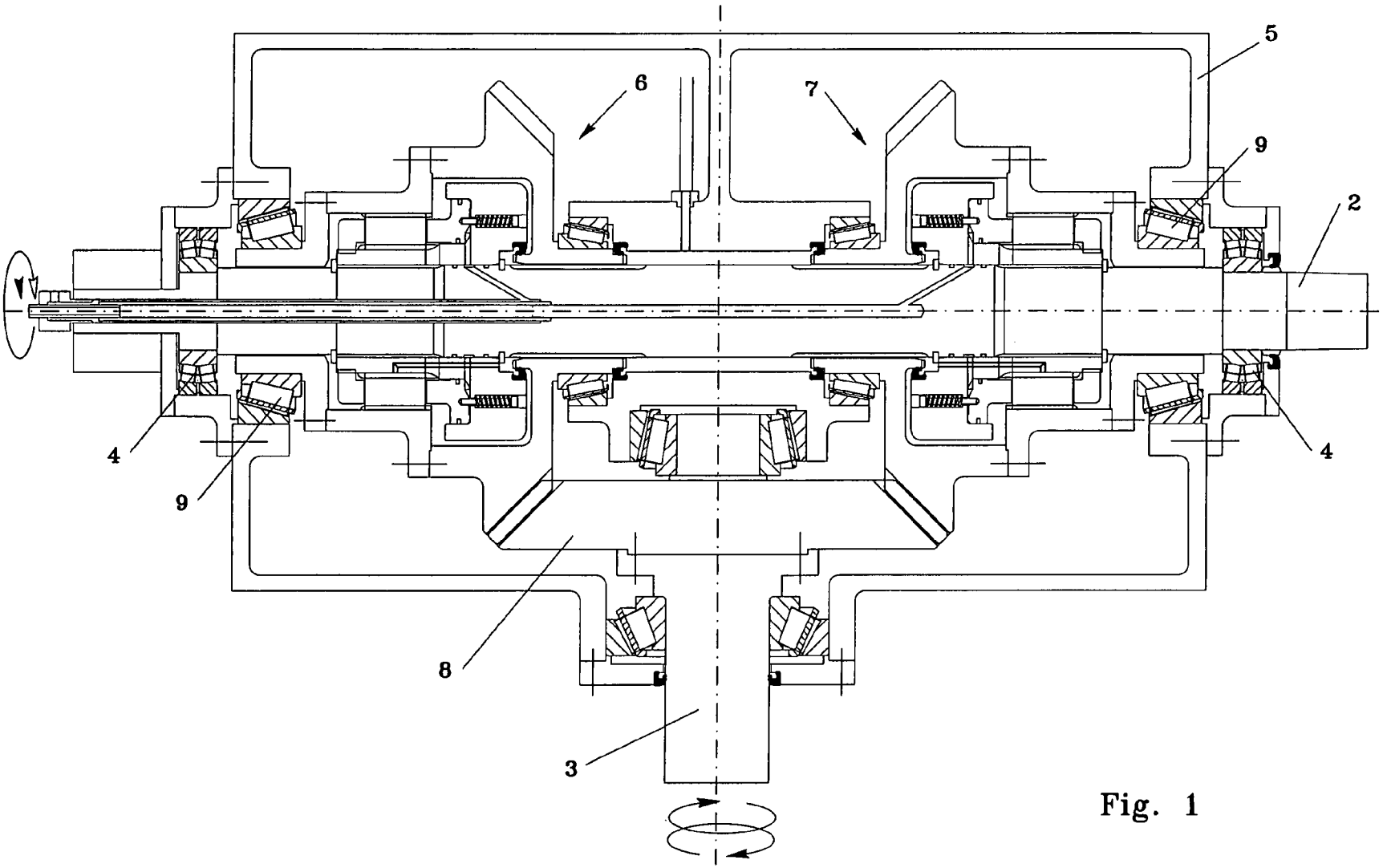
FIG. 1 schematically illustrates, in cross-section, a drive unit according to the invention.

FIG. 1 shows the drive unit according to the invention, which receives motion from shaft 2 leading from the engine and transmits it to a shaft 3, fitted at a 90-degree angle to shaft 2, which said shaft 3 constitutes the drive shaft of a stern drive leading to the propellers. Shaft 2 is mounted on bearings 4 in a housing 5 with a rigid structure which contains the kinematic mechanism constituting the drive unit. A pair of coaxial bevel gears 6 ad 7, which are fitted idle opposite one another on shaft 2, both engage with a bevel gear 8 keyed to shaft 3.

Figure 2:
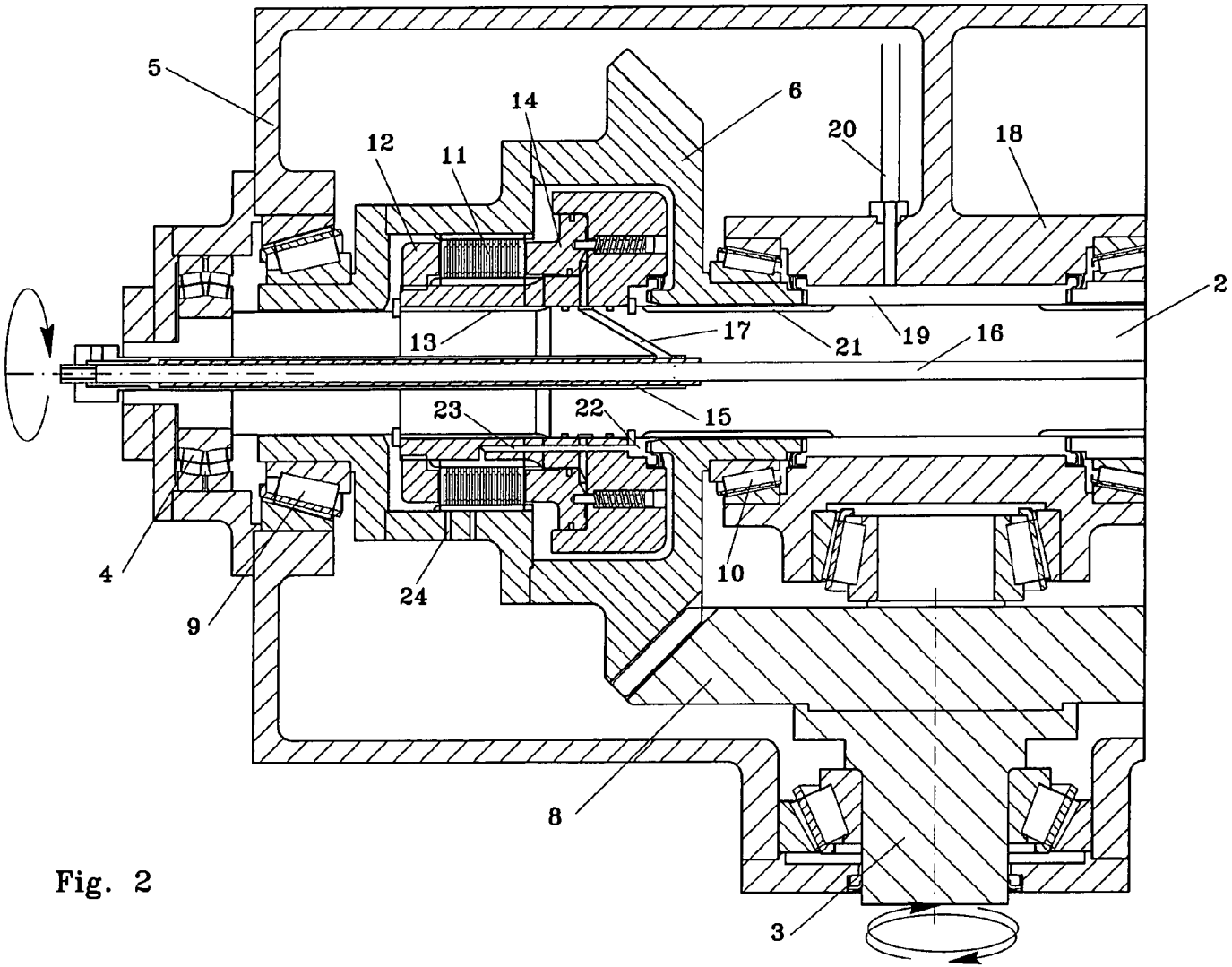
FIG. 2 illustrates, again in cross-section, an enlarged part of the drive unit shown in FIG. 1.

As shown in FIG. 2, each of bevel gears 6 and 7 is mounted on a pair of bearings 9 and 10, which in turn are mounted on the body of housing 5.

The central area of housing 5 contains a hollow support 18, to which bevel gear bearings 10 are fitted and through which engine shaft 2 passes. Bevel gears 6 and 7 can therefore rotate freely in relation to housing 5 and shaft 2.

The body of bevel gears 6 and 7 is hollow, and each of them houses a clutch unit shown in detail in FIG. 2.

Said clutch unit comprises a multi-disk clutch 11 wherein some of the disks are connected with the body of the bevel gear, while others are connected with a support 12 mounted on shaft 2 which presents a groove that engages a corresponding groove 13 on the shaft, thus causing said support 12 to rotate.

Support 12 comprises a mobile part 14, which slides axially and is forced by pressurised oil, as will be described in greater detail below, to compress the set of disks so as to engage the clutch and mesh support 12 with the body of the corresponding bevel gear.

In the absence of pressurised oil feed, the bevel gears can rotate freely in relation to shaft 2 and housing 5; if a pressurised fluid is conveyed so that clutch 11 is engaged, the bevel gear meshes with the corresponding support 12, which is caused to rotate by shaft 2.

According to the invention, pressurised oil originating from a pump of known type, not illustrated in the figure, is conveyed to clutches 11 through a pair of coaxial pipes indicated as 15 and 16, installed on the same axis as shaft 2.

Pipe 15 conveys pressurised oil, through a branch pipe 17, to the clutch contained in bevel gear 6, while pipe 16 conveys oil to the clutch of bevel gear 7.

Multi-disk clutch 11 operates in an oil bath, and therefore require a sufficient amount of lubricant, which must be kept in circulation in order to be suitably cooled.

According to an advantageous aspect of the invention, central body 18 of housing 5 has an inner diameter greater than the diameter of shaft 2, so as to form an annular chamber 19 to which a pipe 20, that conveys cooling and lubricating oil, leads.

Around the perimeter of shaft 2 there are a series of channels 21 which place chamber 19 in communication with a second annular chamber shown as no. 22 in FIG. 2, between support 12, the bevel gear and the shaft.

Annular chamber 22 communicates with annular clutch 11 via one or more pipes 23 parallel to the shaft axis.

A set of calibrated holes 24 in the body of bevel gear 6 allow said oil to exit and return into circulation in housing 5, from which it is taken up and returned to circulation by a pump of known type, not illustrated in the figure.

The operation of the unit according to the invention is as follows.

Shaft 11, driven by the boat engine, is caused to rotate around its own axis and activates a pump which pressurises the oil designed to control the engagement of clutches 11 and the oil designed to cool them.

In order to control the rotation of the propeller in one direction, for example to move the boat in a forward direction, pressurised oil is conveyed, by means of a control valve of known type not illustrated in the figures, through pipe 15, for example, to activate clutch 11 housed inside bevel gear 6.

Said bevel gear then meshes with shaft 2, which causes it to rotate.

The motion is transmitted from bevel gear 6 to bevel gear 8 and shaft 3, and from there to the propellers.

To reverse the motion, it is sufficient to operate the control valve to release the clutch of bevel gear 6, which can thus rotate freely in relation to the shaft, and cause bevel gear 7 to mesh with shaft 2 via the corresponding clutch, by sending pressurised oil through pipe 16.

As bevel gear 7 is fitted in the opposite direction to bevel gear 6, it causes bevel gear 8 to rotate in the opposite direction to the preceding one, thus reversing the movement of the propeller and consequently the direction of travel of the boat.

As pipes 15 and 16 have a small diameter and are located on the rotation axis of shaft 2, in correspondence with the engagement with the pressurised oil feed devices, the peripheral speed will be minimal, and no major seal problems will arise.

Equally, although the cooling and lubricating oil of clutches 11 is conveyed to annular chamber 19 where the peripheral speed of the mobile parts is greatest, it creates no problems, since this fluid is at a much lower pressure of approx. 2–3 bars.

As will appear clearly from the description supplied, the drive unit according to the invention presents numerous advantages, including its overall compactness, which allows the use of a stern drive with a considerable saving of space, the rigidity and robustness of the unit, because the various transmission parts discharge reactions directly onto the housing of the device and not onto other parts, and the possibility of reversing the rotation without the need for an external reverse gears, as in the case of known devices.

Moreover, the fact that the bearings are mounted on the housing allows them to be lubricated by passing the oil pipes through a fixed structure and not through rotating parts, which allows better control of the flow rate.

Although the invention has been described with particular reference to application to the shipbuilding industry, a drive unit as described could obviously be used just as effectively in other industries.

The invention claimed is:

1. A drive unit for a boat, comprising:

a rigid housing;

a transmission with first and second coaxial bevel gears mounted opposite one another on an engine shaft inside said housing, said first and second bevel gears engaging a third bevel gear fitted to a further shaft that extends from said housing orthogonal to said engine shaft;

first and second clutches that each engages a respective one of said first and second bevel gears with said engine shaft, said first and second clutches each being inside a respective one of said first and second bevel gears; and plural bearings that mount said engine shaft and said first and second bevel gears on said housing so as to discharge reaction forces to said housing.

2. The drive unit of claim 1, wherein said first and second bevel gears are each fitted on one side to a respective one of said bearings mounted on said housing and on an opposite side to at least a further one of said bearings that is mounted on a central support integral with said housing.

3. The drive unit of claim 1, wherein said first and second clutches are multi-disk clutches with forced and controlled lubrication and cooling.

4. The drive unit of claim 1, further comprising plural pipes in said engine shaft that convey a pressurised fluid to said first and second clutches.

5. The drive unit of claim 4, wherein said plural pipes are coaxial with said engine shaft.

6. The drive unit of claim 1, further comprising, a first annular chamber bounded by said housing, said engine shaft, and said first and second bevel, a second annular chamber inside each of said first and second bevel gears and that communicates with said first annular chamber by means of a series of channels in a surface of said engine shaft, and wherein said first annular chamber communicates with a pipe that carries a cooling fluid and said second annular chamber communicates with said first and second clutches.

7. The drive unit of claim 1, wherein said first and second clutches are each mounted on said engine shaft.

* * * * *